US009327501B2

(12) United States Patent
Hanagami et al.

(10) Patent No.: US 9,327,501 B2
(45) Date of Patent: May 3, 2016

(54) INKJET-HEAD AND INK JET PRINTER

(71) Applicant: SEIKO EPSON CORPORATION, Tokyo (JP)

(72) Inventors: Taiki Hanagami, Matsumoto (JP); Isamu Togashi, Matsumoto (JP); Haruki Kobayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/743,392

(22) Filed: Jun. 18, 2015

(65) Prior Publication Data

US 2015/0367638 A1 Dec. 24, 2015

(30) Foreign Application Priority Data

Jun. 19, 2014 (JP) ..... 2014-126185

(51) Int. Cl.
*B41J 2/175* (2006.01)
*B41J 2/14* (2006.01)

(52) U.S. Cl.
CPC ..... *B41J 2/1433* (2013.01)

(58) Field of Classification Search
None
See application file for complete search history.

(56) References Cited

U.S. PATENT DOCUMENTS 8,757,774 B2 6/2014 Hanagami et al.
2013/0033539 A1* 2/2013 Watanabe et al. ..... 347/20

FOREIGN PATENT DOCUMENTS

JP 2012-240341 A 12/2012
JP 2013-119165 A 6/2013

* cited by examiner

*Primary Examiner* — Erica Lin
(74) *Attorney, Agent, or Firm* — Workman Nydegger

(57) ABSTRACT

An inkjet-head includes a first flow path member in which a plurality of first flow paths are formed; and a second flow path member in which a plurality of second flow paths are formed and to which the first flow path member is bonded. The second flow paths have intra-joint-surface flow paths, respectively, which are formed by surrounding, with a first adhesive, a peripheral edge of a groove formed in the second flow path member and bonding the first flow path member thereto. A joint space is formed and includes a plurality of the intra-joint-surface flow paths due to surrounding, with a second adhesive, an outer periphery of the intra-joint-surface flow path and bonding the second flow path member and the first flow path member. At least a part of the second adhesive is formed further inside of a straight line connecting an end of one intra-joint-surface flow path on the outer side and an end of another intra-joint-surface flow path on the outer side in joined surfaces.

4 Claims, 9 Drawing Sheets

INKJET-HEAD AND INK JET PRINTER

CROSS-REFERENCE TO RELATED APPLICATIONS

The entire disclosure of Japanese Patent Application No: 2014-126185, filed Jun. 19, 2014 is expressly incorporated by reference herein in its entirety.

BACKGROUND

1. Technical Field

The present invention relates to an inkjet-head such as an ink jet type recording head and an ink jet printer including the inkjet-head, and particularly makes it possible to achieve miniaturization of the inkjet-head and the ink jet printer.

2. Related Art

An ink jet printer includes a permanent head and ejects (discharges) various liquids from the permanent head. The ink jet printer is a non-impact printer in which a character is formed through ejection of particles or small droplets of ink onto a sheet (JIS X0012-1990). The printer is a type of dot printer (JIS X0012-1990) which prints a character or an image expressed with a plurality of dots and prints a character or an image expressed with a plurality of dots which are formed by ejecting particles or small droplets of ink. In addition, the permanent head is a machine unit or an electrical unit of a printer body which continually or intermittently produces ink droplets (hereinafter, referred to as "inkjet-head) (JIS Z8123-1: 2013). The ink jet printer has been applied to various manufacturing apparatuses due to its characteristics of being capable of causing a very small amount of a liquid to land at a predetermined position with accuracy, as well as being used in an image recording apparatus. For example, the ink jet printer is applied to a display manufacturing apparatus that manufactures a color filter such as a liquid crystal display, an electrode producing apparatus that produces an electrode, such as an organic electro luminescence (EL) display or a field emission display (FED), and a chip manufacturing apparatus that manufactures a bio chip (biochemical component). A recording head for the image recording apparatus ejects liquid-phase ink, and a color-material ejecting head for the display manufacturing apparatus ejects solutions of respective color materials which are red (R), green (G), and blue (B). In addition, an electrode-material ejecting head for the electrode producing apparatus ejects a liquid-phase electrode material and a bio-organic material ejecting head for the chip manufacturing apparatus ejects a solution of a bio-organic material.

The inkjet-head described above is formed of a plurality of flow path members and the like which are stacked and a liquid is supplied to a pressure chamber via a flow path formed in each of the flow path members. Accordingly, driving of a piezoelectric element (a type of actuator) brings about pressure fluctuation in the liquid in the pressure chamber such that a liquid droplet is caused to be ejected from a nozzle. Such an inkjet-head includes one which is configured to form a space between joined surfaces by interposing an annular sealing member formed of a resin such as an elastomer between a first flow path member and a second flow path member which is joined thereto and to include a level flow path which extends in a joint-surface direction (for example, JP-A-2013-119165). Accordingly, the space communicates with the outside via an atmosphere opening path formed in the sealing member such that the sealing member is not broken due to expansion of air or the like in response to a temperature change.

However, when, as described above, the first flow path member and the second flow path member are joined to each other through the sealing member, there is a concern that the first flow path member or the second flow path member may be deformed due to a restoring force (resilience) of the sealing member. Therefore, it is not possible to form thin flow path members due to an object to secure rigidity. In addition, since the atmosphere opening path is formed in the sealing member, the sealing member itself becomes thicker. Therefore, the inkjet-head becomes thicker and it is difficult for the inkjet-head to be decreased in size.

SUMMARY

An advantage of some aspects of the invention is to provide an inkjet-head and an ink jet printer which can be smaller in size.

An inkjet-head according to an aspect of the invention includes a first flow path member in which a plurality of first flow paths are formed; and a second flow path member in which a plurality of second flow paths are formed and to which the first flow path member is bonded. The second flow paths have intra-joint-surface flow paths, respectively, which are formed by surrounding, with a first adhesive, a peripheral edge of a groove formed in the second flow path member and bonding the first flow path member thereto. A joint space is formed and includes a plurality of the intra-joint-surface flow paths due to surrounding, with a second adhesive, an outer periphery of the intra-joint-surface flow paths and bonding the second flow path member and the first flow path member. At least a part of the second adhesive is formed further inside a straight line connecting an end of one intra-joint-surface flow path on the outer periphery and an end of another intra-joint-surface flow path on the outer periphery in joined surfaces.

According to the invention, it is possible for the inkjet-head to become thinner than in a case where another member in which an atmosphere opening path is formed is interposed between the first flow path member and the second flow path member. In addition, since a restoring force due to interposing the other member is not produced, it is possible for the first flow path member and the second flow path member to be thin. As a result, it is possible for the inkjet-head to be decreased in size. Further, since at least a part of the second adhesive is formed further inside the virtual straight line connecting the end of one intra-joint-surface flow path on the outer periphery and the end of the other intra-joint-surface flow path on the outer periphery in joined surfaces, it is possible for the joint space to have a smaller volume and humidity is likely to be maintained in the joint space.

In the inkjet-head, it is desirable that gas permeability of a second hardened product obtained by hardening the second adhesive is lower than gas permeability of a first hardened product obtained by hardening the first adhesive.

In the configuration, although moisture of the intra-joint-surface flow path is transmitted through the first adhesive, it is difficult for the moisture to be transmitted through the second adhesive. Therefore, humidity is more likely to be maintained in the joint space.

An ink jet printer according to another aspect of the invention includes the inkjet-head having any configuration described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the invention will be described with reference to the accompanying drawings. The embodiments to be described below are limited in various ways as appropriate embodiments according to the invention; however, a range of the invention is not limited thereto as long as there is not, particularly, provided a description indicating that the invention is limited thereto in the following description. Hereinafter, an ink jet printer according to an embodiment of the invention will be described with an ink jet type image recording apparatus (hereinafter, printer) as an example.

Figure 1:
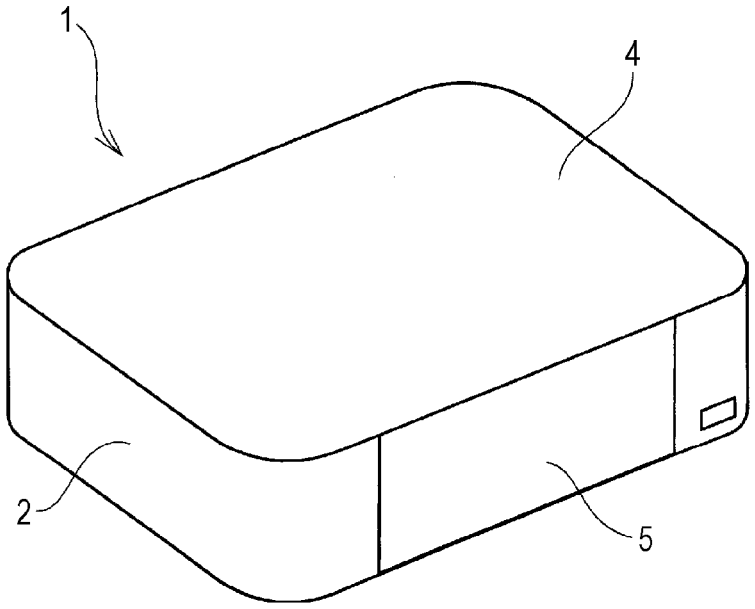
FIG. 1 is a perspective view illustrating an external configuration of a printer.
Figure 2:
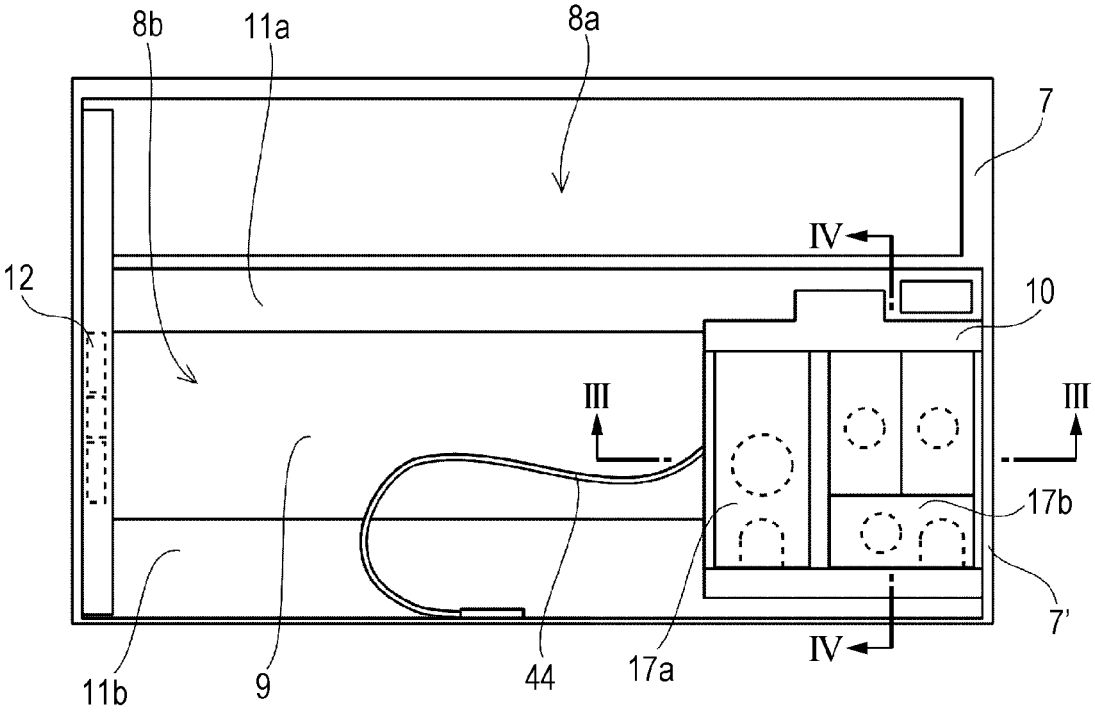
FIG. 2 is a plan view illustrating an internal configuration of the printer.
Figure 3:
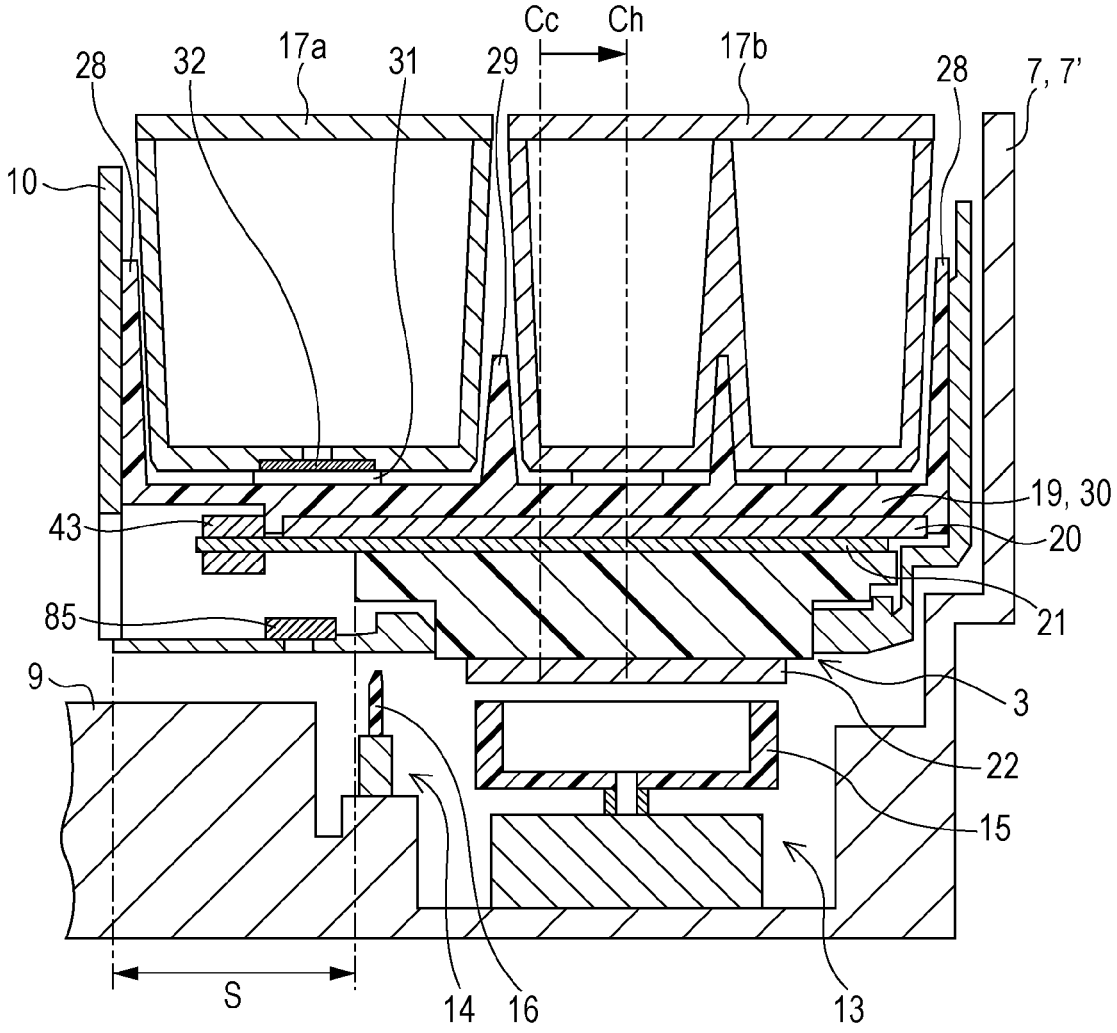
FIG. 3 is a cross-sectional view taken along line III-III in FIG. 2.
Figure 4:
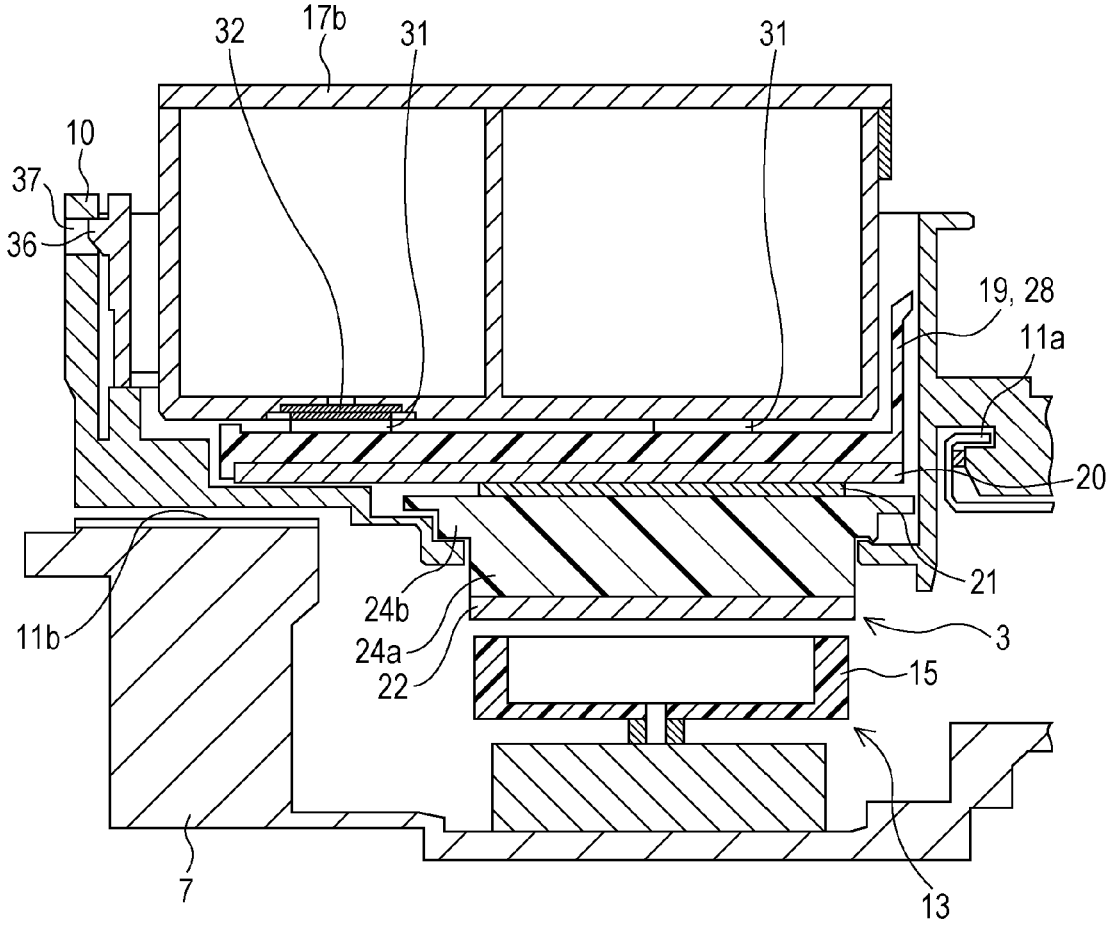
FIG. 4 is a cross-sectional view taken along line IV-IV in FIG. 2.

FIG. 1 is a perspective view illustrating an external configuration of a printer 1 and FIG. 2 is a plan view illustrating an internal configuration of the printer 1. In addition, FIG. 3 is a cross-sectional view taken along line III-III in FIG. 2 and FIG. 4 is a cross-sectional view taken along line IV-IV in FIG. 2. A printer 1 according to the present embodiment includes an ink jet type recording head (hereinafter, recording head 3), that is, a type of inkjet-head, which is mounted on a carriage 10 inside a housing 2 of a printer body. The printer 1 is configured to eject ink (a type of liquid) from a nozzle 63 of the recording head 3 onto a recording sheet, a card, or the like (a type of recording medium or liquid landing target) and thereby to print a photographic image or text on the recording sheet or the like. A body cover 4 and a front cover 5 are provided on a top-surface side and a front-surface side of the housing 2, respectively. The body cover 4 and the front cover 5 are connected and are configured such that edge sections on the front-surface side can be raised and rotated to a rear-surface side with an edge section of the housing 2 on the rear-surface side as an axis and the top surface of the housing 2 can be open. In a state in which the body cover 4 and the front cover 5 are open, the covers 4 and 5 function as a paper feeding tray on which the recording medium or the like is set. In addition, in a state in which the body cover 4 and the front cover 5 are open, replacement work of an ink cartridge 17 or the like can be performed.

The inside of the housing 2 is partitioned by a metal body frame 7 into a paper feeding section 8*a* in which a paper feeding mechanism (not illustrated) or the like is provided so as to feed the recording sheet or the like to a side of a platen 9 and a printing section 8*b* in which the recording head 3 performs printing (recording operation) on the recording sheet or the like fed on the platen 9. Guide frames 11*a* and 11*b* are provided on the rear-surface side and the front-surface side of the printing section 8*b* of the body frame 7, respectively, in parallel with each other in a longitudinal direction of the housing 2. The carriage 10 is supported by the guide frames 11*a* and 11*b* at the front and the rear thereof. The carriage 10 is configured to be guided by a driving force from a driving motor (not illustrated) along the guide frames 11*a* and 11*b* in a reciprocally movable manner.

A home position which is a standby position of the recording head 3 and a base point of scanning is set on one end side (right side in FIG. 2) in a movement range of the carriage 10. As illustrated in FIG. 3, at the home position, a capping mechanism 13 (capping unit) and a wiping mechanism 14 (wiping unit) are provided in this order from one end side (side close to a one-end-side side wall 7' of the body frame 7). The capping mechanism 13 includes a cap 15 formed of an elastic member for example, of an elastomer and is configured such that the cap 15 is switchable between a sealing state (capping state) of being in contact with a head cover 26 (refer to FIG. 7 and FIG. 8) provided to surround a periphery of a nozzle surface of the recording head 3 and a retracted state of being separated from the head cover 26. The capping mechanism 13 is configured so as to cause the inside of the cap 15 to be under negative pressure using a pump (not illustrated) in the capping state and thereby to perform a cleaning operation through which ink or air bubbles are discharged from the nozzle 63 of the recording head 3. A driving component 12 related to transport of the recording sheet or the like on the platen 9 is provided to be adjacent to the platen 9, on the other end side (left side in FIG. 2) opposite to the home position side in the movement range of the carriage 10. The driving component 12 is configured of, specifically, a driving gear or the like which transmits a driving force of a motor for transporting the recording sheet to a transport roller or the like.

The wiping mechanism 14 causes the wiper 16 to sweep the nozzle surface of the recording head 3 and is configured such that the wiper 16 is switchable between a state of being in contact with the nozzle surface and a retracted state of being separated from the nozzle surface. The wiper 16 can have various configurations and, examples of the wiper include one in which a moisture-repellent film is formed on a surface of a blade body formed of a resin or the like, or a cloth wiper of which a contact portion with the nozzle surface is formed of cloth. According to the present embodiment, in a state in which the wiper 16 comes into contact with the nozzle surface of the recording head 3, the carriage 10 moves in a main scanning direction and the wiper 16 slides over and sweeps the nozzle surface. It is possible to employ a configuration in which, in a state in which the recording head 3 stops its movement, the wiper 16 itself travels and sweeps the nozzle surface. In short, the recording head 3 and the wiper 16 may be configured to relatively move and the nozzle surface is swept.

Figure 5:
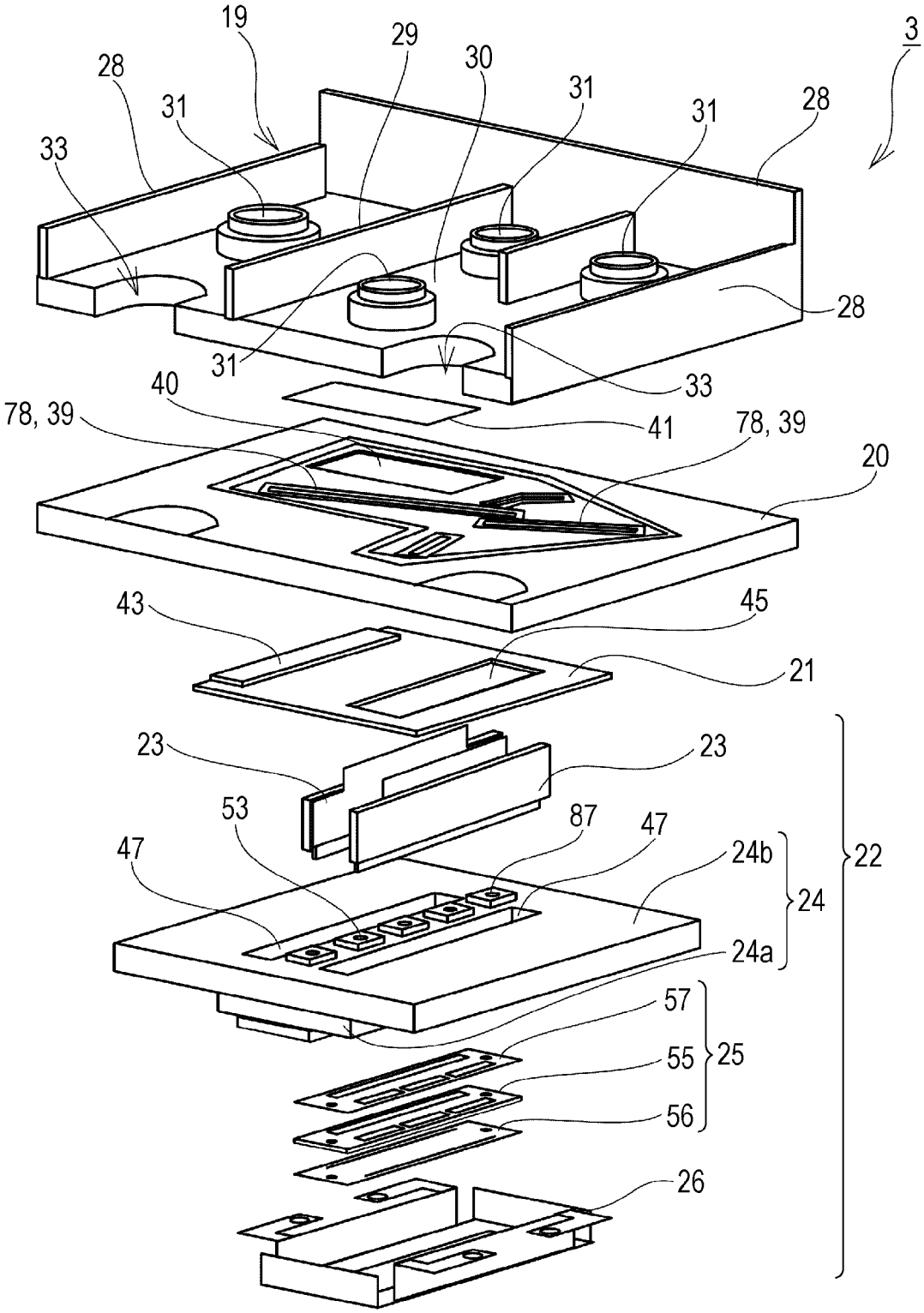
FIG. 5 is an exploded perspective view illustrating a configuration of a recording head.
Figure 6:
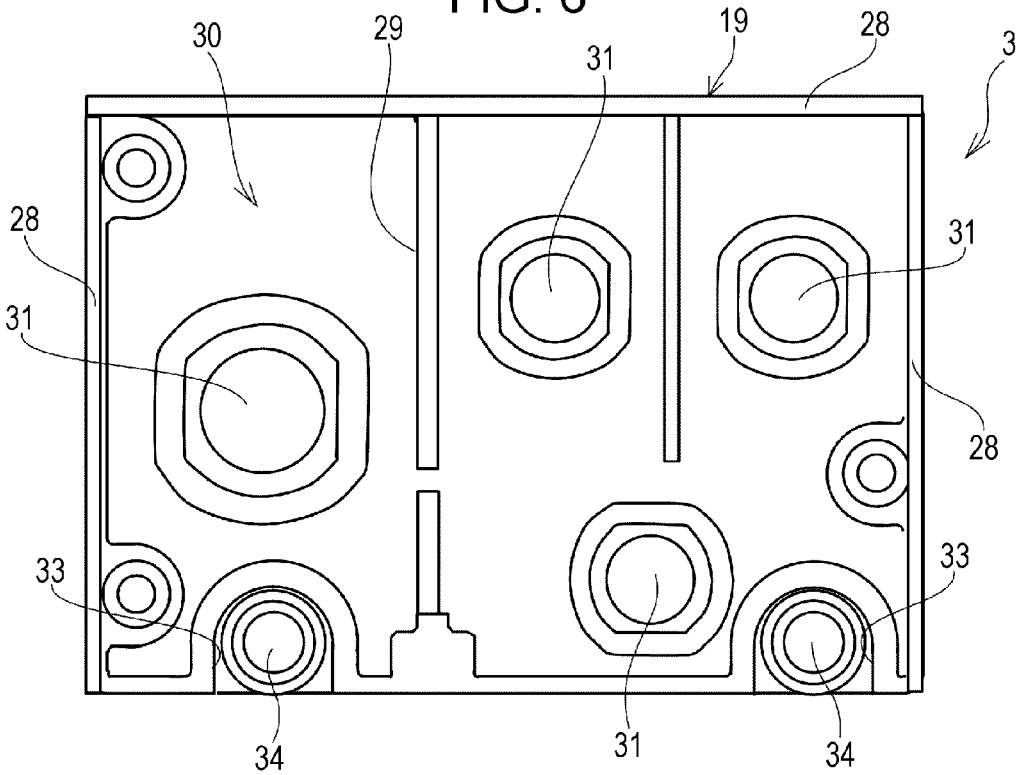
FIG. 6 is a top-surface view illustrating the configuration of the recording head.
Figure 7:
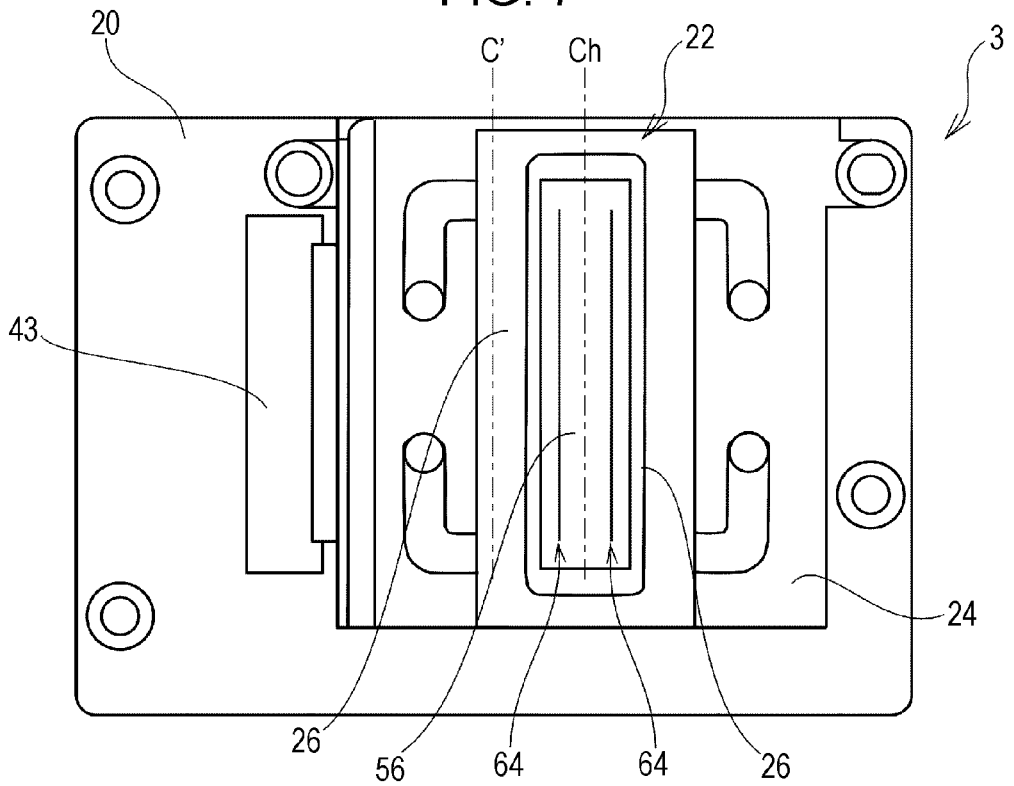
FIG. 7 is an under-surface view illustrating the configuration of the recording head.
Figure 8:
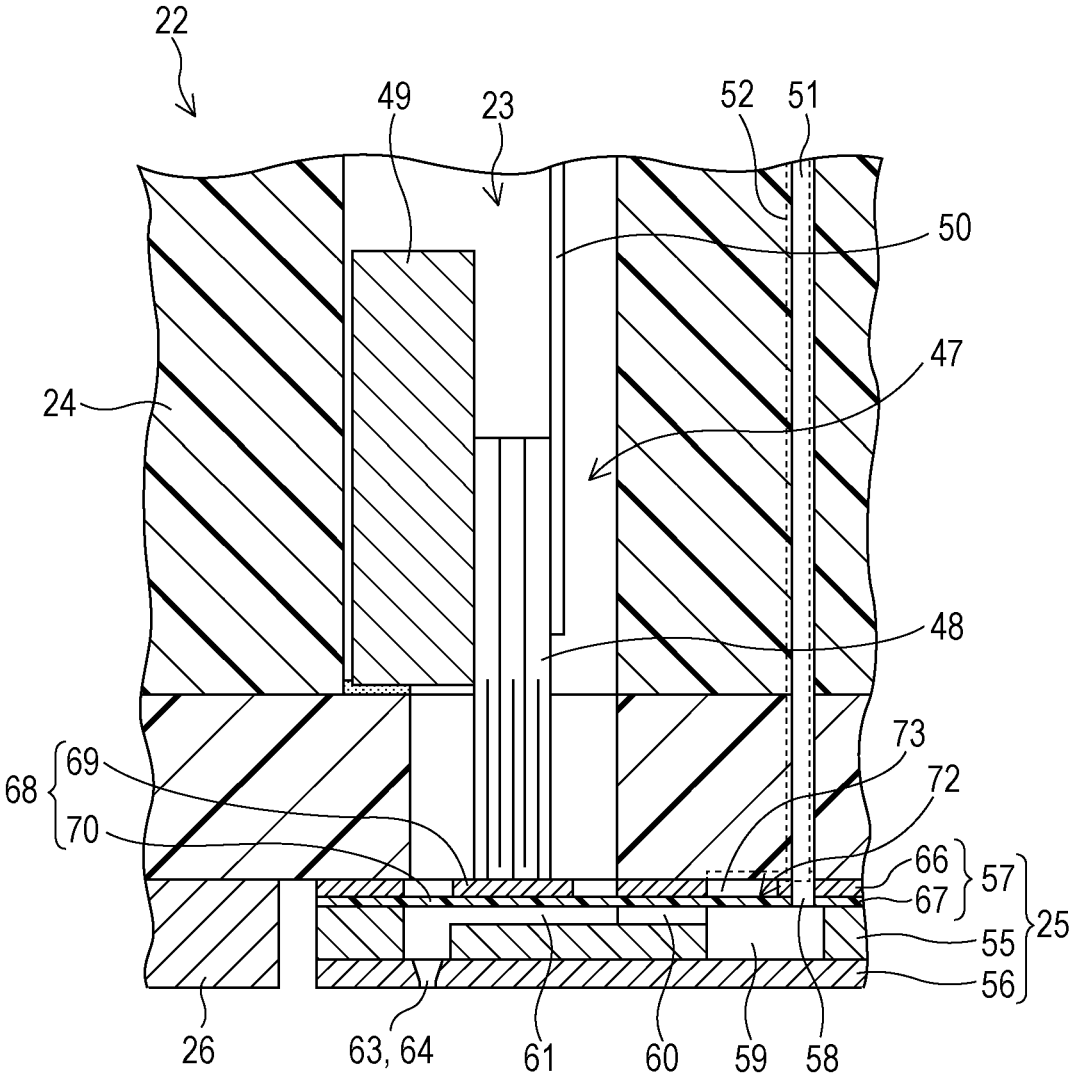
FIG. 8 is a cross-sectional view illustrating main parts of the configuration of the recording head.

FIG. 5 is an exploded perspective view illustrating a configuration of the recording head 3. In addition, FIG. 6 is a top-surface view (plan view) illustrating the configuration of the recording head 3 and FIG. 7 is an under-surface view illustrating the configuration of the recording head 3. Further, FIG. 8 is a cross-sectional view illustrating main parts of an internal configuration of the recording head 3. In FIG. 8, a configuration corresponding to the nozzle row 64 on the other side is omitted. The recording head 3 according to the present embodiment includes a holder 19 (corresponding to a first flow path member in the invention), a flow path plate 20 (corresponding to a second flow path member in the invention), a circuit substrate 21, and a head unit 22 as head components. In addition, the head unit 22 includes a vibrator unit 23, a head case 24, a flow path unit 25, and the head cover 26 as head unit components.

The holder 19 according to the present embodiment is a member made of a synthetic resin and includes a base plate 30 and an outer wall 28 which is uprightly provided upward from an edge of the base plate 30 on both sides in a horizontal direction (scanning direction of the carriage 10) and on the rear side in the front-rear direction (transport direction of the recording sheet or the like). In addition, the top surface of the base plate 30 is partitioned by a partition wall 29 provided inside of the outer wall 28 into an arrangement region (in FIG. 6, a region on the left side of the partition wall 29) for a black ink cartridge 17*a* and an arrangement region (in FIG. 6, a region on the right side of the partition wall 29) for a color ink cartridge 17*b*. Ink guiding-in units 31 are provided in the cartridge arrangement regions, respectively. The ink guiding-in unit 31 is a portion which is connected to an ink guiding-out unit 32 of the ink cartridge 17 and is provided for each color of ink. According to the present embodiment, the ink guiding-in units 31 are provided at a total of four positions, respectively, corresponding to a total of four colors of ink of black ink, cyan ink, magenta ink, and yellow ink. The ink guiding-in unit 31 includes a filter and a porous member (absorbent member) (not illustrated) inside an opening of a cylindrical section. In addition, a porous member is also provided in the ink guiding-out unit (refer to FIG. 3 and FIG. 4) of the ink cartridge 17 and the two porous members come into contact with each other and ink is transferred when the ink guiding-out unit 32 and the ink guiding-in unit 31 come into contact with each other. In addition, inside the holder 19, an intra-holder flow path 76 (corresponding to a first flow path in the invention) is formed and supplies the ink guided in from the ink guiding-in unit 31 to the flow path plate 20 side (refer to FIG. 11A). When the ink is guided in from the ink guiding-in unit 31, the ink is filtered through the filter, then, passes through the intra-holder flow path 76 and an intermediate flow path 39 of the flow path plate 20 to be described below, and is supplied to the head unit 22 side.

As illustrated in FIG. 5 and FIG. 6, a notch 33 which has a substantially semi-circular shape in a plan view is formed on an edge section of the base plate 30 on the front-surface side in the holder 19. As illustrated in FIG. 6, the notch 33 is a cavity in which a biasing member 34 formed of a coil spring is disposed. The bottom of the notch 33 is blocked by the flow path plate 20 and the biasing member 34 is attached on the portion. In a state (refer to FIG. 4) in which the ink cartridge 17 is mounted on the holder 19 and a latch claw 36 on the ink cartridge 17 side latches into a latch-hold opening 37 on the carriage 10 side, the biasing member 34 biases the ink cartridge 17 upward and causes the latching state to be maintained. When the ink cartridge 17 is removed from the holder 19 and the latching state of the latch claw 36 is released from the latch-hold opening 37, the ink cartridge 17 is raised upward due to a biasing force from the biasing member 34 and, in this configuration, the ink cartridge 17 is easily removed. According to the present embodiment, the notches 33 are provided at two positions in the base plate 30 corresponding to the ink cartridge 17*a* and the ink cartridge 17*b*, respectively.

Figure 10A:
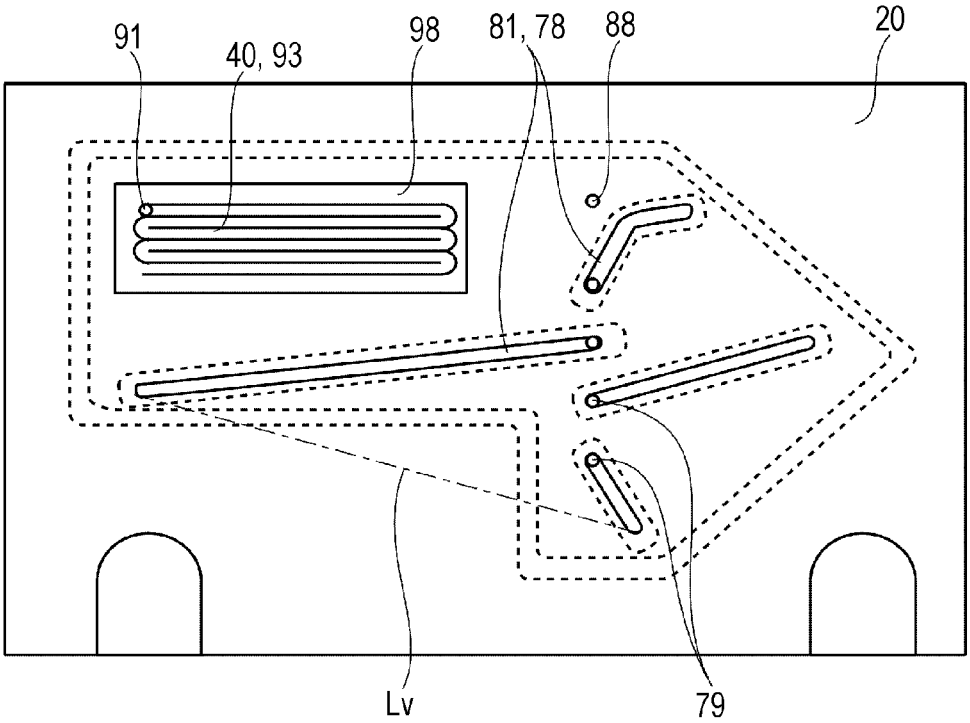
FIG. 10A is a plan view of a flow path plate before a base plate is joined and FIG. 10B is a plan view of the flow path plate after the base plate is joined.
Figure 10B:
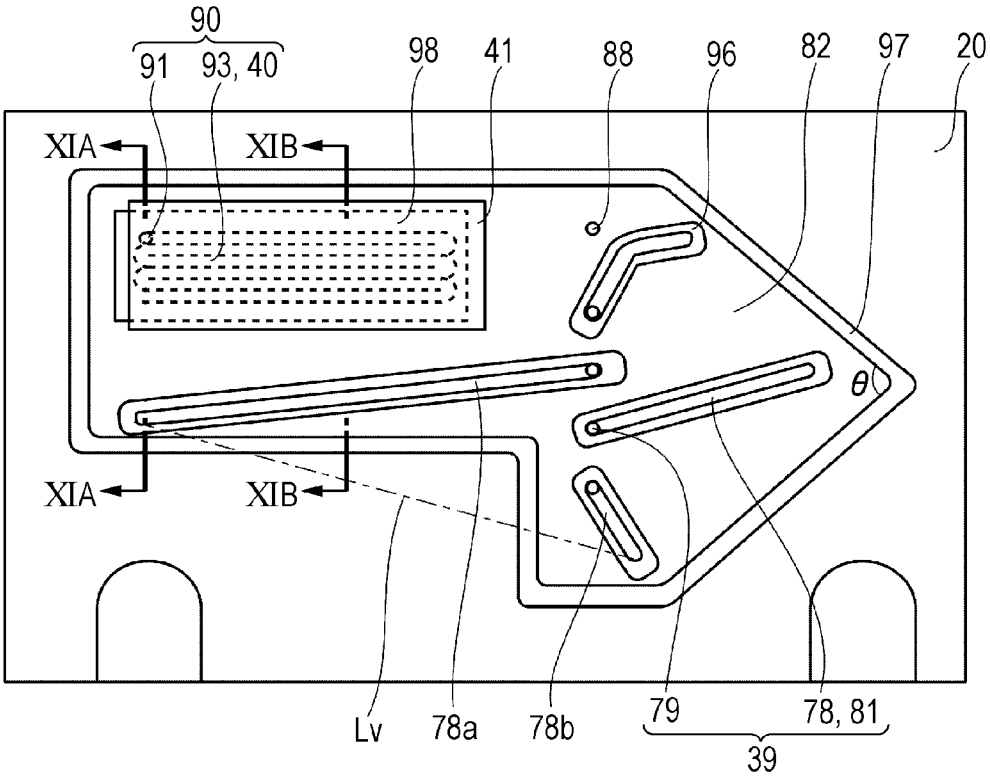

In the flow path plate 20 which is joined to the undersurface of the holder 19, a total of four intermediate flow paths 39 (corresponding to second flow paths in the invention) are formed for each color of ink. As illustrated in FIG. 5 and FIGS. 10A and 10B, the intermediate flow path 39 is an ink flow path configured to include an intra-joint-surface flow path 78 which is formed on the top surface (surface joined to the holder 19) of the flow path plate 20 and extends in the corresponding surface direction and an intra-plate flow path 79 which penetrates the flow path plate 20 in a thickness direction thereof and is open on the undersurface (surface on the head unit 22 side) of the flow path plate 20. The lower end of the intra-plate flow path 79 communicates with a case flow path 51 (refer to FIG. 8) provided inside a case through a flow path connecting unit 53 of the head case 24 in the head unit 22. In addition, a meandering route forming groove 40 (corresponding to an atmosphere opening groove in the invention) is formed on the top surface of the flow path plate 20 so as to meander in the top surface of the flow path plate 20. A thin film 41 is joined over the upper opening of the meandering route forming groove 40 and a meandering route 93 (a part of an atmosphere opening path 90) to be described below is configured. Further, in a portion outside of a region in which the intra-joint-surface flow path 78 and the meandering route forming groove 40 are formed, an atmosphere opening intra-head through-hole 88 (refer to FIGS. 10A and 10B) is formed to penetrate the flow path plate 20 in the thickness direction and to communicate with an atmosphere opening communicating path 52 via an atmosphere opening connection unit 87 of the head case 24 to be described below. Accordingly, an adhesive (second adhesive 97) is applied so as to enclose a region in which the intra-joint-surface flow path 78, the meandering route forming groove 40, and the atmosphere opening intra-head through-hole 88 are formed and the region is sealed when the flow path plate 20 and the holder 19 are joined. Then, a joint space 82 (refer to FIGS. 11A and 11B) is formed to include upper openings of the intra-joint-surface flow path 78, the meandering route forming groove 40, and the atmosphere opening intra-head through-hole 88. The intra-joint-surface flow path 78, the meandering route 93, the atmosphere opening intra-head through-hole 88, and the joint space 82 will be described below in detail.

As illustrated in FIG. 5, the circuit substrate 21 is disposed between the flow path plate 20 and the head case 24 of the head unit 22. The circuit substrate 21 relays a drive signal, other control signals, or the like which are transmitted to a piezoelectric element 48 from the printer body. In the circuit substrate 21, a terminal area (not illustrated) is formed to be electrically connected to a terminal area of a flexible cable 50 to be described below and a connector 43 or other electronic components which are connected to the printer body side are mounted. An FFC (flexible flat cable) 44 is connected to the connector 43 (refer to FIG. 2) and the circuit substrate 21 is configured to receive a drive signal or the like through the FFC 44 from the printer body side. In a state in which the circuit substrate 21 is assembled into the recording head 3 and the recording head 3 is fixed to the carriage 10, the connector 43 is arranged in an accommodation space S on a side opposite to the one-end-side side wall 7' of the body frame 7 in the carriage scanning direction, in the carriage 10 (refer to FIG. 3).

As illustrated in FIG. 5, in the circuit substrate 21, a substrate opening 45 is formed to penetrate the circuit substrate in a substrate thickness direction. The substrate opening 45 is a clearance hole through which one end side of the flexible cable 50 (refer to FIG. 8) drawn out from a storage space 47 of the head case 24 is inserted and the other end thereof being connected to the piezoelectric element 48 and through which the flow path connecting unit 53 which is an upstream-side end of the case flow path 51 of the head case 24 or the atmosphere opening connection unit 87 which is an upstream-side end of the atmosphere opening communicating path 52 is inserted. When the head case 24 and the flow path plate 20 are joined in a state of interposing the circuit substrate 21 therebetween, the flow path connecting unit 53 of the head case 24 is inserted through the substrate opening 45 of the circuit substrate 21 and is connected to the intermediate flow path 39 (lower end of the intra-plate flow path 79) of the flow path plate 20. In addition, the atmosphere opening connection unit 87 is inserted through the substrate opening 45 of the circuit substrate 21 and is connected to the lower end of the atmosphere opening intra-head through-hole 88 of the flow path plate 20.

The head case 24 is mainly formed of a synthetic resin such as an epoxy resin. The head case 24 according to the present embodiment includes a case body section 24*a* on the lower side to which the flow path unit 25 is joined and a flange 24*b* further above the case body section 24*a*. A portion (lower end portion) of the case body section 24*a*, to which the flow path unit 25 is joined, is formed of a metal such as a stainless steel. In addition, a size of the flange 24*b* in a direction (carriage scanning direction) orthogonal to a nozzle row direction is set to be greater than a size of the case body section 24*a* in the same direction. Inside the head case 24, the storage space 47 is formed in a state of penetrating the head case in the height direction so as to store the vibrator unit 23.

In addition, as illustrated in FIG. 8, in the head case 24, the case flow path 51 is formed in a state of penetrating the head case in the height direction at a position apart from the storage space 47 on the outer side in the carriage scanning direction. In the present embodiment, the four case flow paths 51 corresponding to the four colors of ink are aligned substantially at the center of the head unit 22 in the nozzle row direction. The upstream-side end of the case flow path 51 is open to the flow path connecting unit 53 formed on the top surface (top surface of the flange 24*b*) of the head case 24 and communicates with the intermediate flow path 39 (intra-plate flow path 79) of the flow path plate 20. In addition, the downstream-side end of the case flow path 51 is open to the undersurface (undersurface of the case body section 24*a*) of the head case 24 and communicates with a common liquid chamber 59 in the flow path unit 25 via a vibrating plate through-hole 58 that is open to a vibrating plate 57 to be described below. Further, in the head case 24, the atmosphere opening communicating path 52 which causes a compliance space 73 which will be described below to be open to the atmosphere is formed at a position apart from the case flow path 51 in the nozzle row direction. One end of the atmosphere opening communicating path 52 is open to the atmosphere opening connection unit 87 formed on the top surface of the head case 24 and communicates with the atmosphere opening intra-head through-hole 88 of the flow path plate 20. In addition, the other end of the atmosphere opening communicating path 52 is open to the undersurface of the head case 24 and communicates with the compliance space 73. The lower end portion of the atmosphere opening communicating path 52 of the present embodiment communicates with a plurality of compliance spaces 73. That is, one common atmosphere opening communicating path 52 is provided for the compliance spaces 73. The atmosphere opening communicating path 52 is disposed on the outer periphery of the case flow path 51 in an alignment direction of the case flow paths 51.

The vibrator unit 23 includes the piezoelectric element 48 that functions as a type of actuator, a fixing plate 49 to which the piezoelectric element 48 is joined, and the flexible cable 50 which supplies a drive signal or the like to the piezoelectric element 48. The piezoelectric element 48 is a stacked type which is formed by dividing, in a comb shape, a piezoelectric plate in which piezoelectric layers and electrode layers are alternately stacked and is a piezoelectric element of a longitudinal vibration mode which is expandable and contractible (transverse electric field effect type) in a direction orthogonal to a stacking direction (electric field direction).

Figure 9:
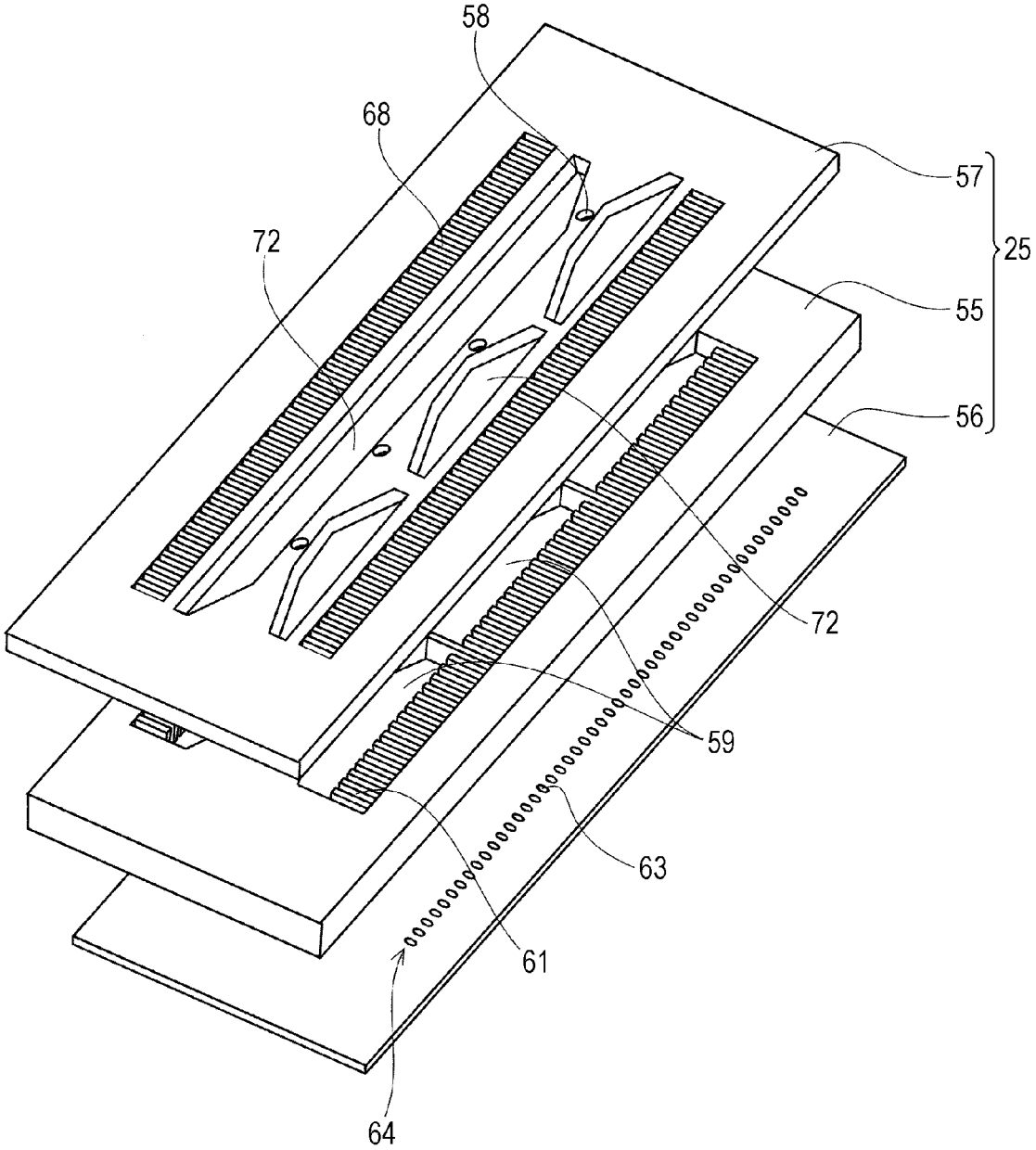
FIG. 9 is an exploded perspective view illustrating a configuration of a flow path unit.

FIG. 9 is an exploded perspective view illustrating a configuration of the flow path unit 25. In the configuration of the flow path unit 25, a nozzle substrate 56 and the vibrating plate 57 are joined to one surface and the other surface of a flow path substrate 55, respectively. That is, the flow path substrate 55, the nozzle substrate 56, and the vibrating plate 57 are components of the flow path unit. As illustrated in FIG. 8 and FIG. 9, in the flow path unit 25, the common liquid chamber (reservoir) 59, an ink supply port 60, a pressure chamber 61, and the nozzle 63 are provided. A line of an ink flow path from the ink supply port 60 via the pressure chamber 61 to the nozzle 63 is formed corresponding to each nozzle 63. In addition, the flow path unit components are all configured of a plate material long in the nozzle row direction.

The nozzle substrate 56 disposed as the lowermost layer of the flow path unit components is a plate member in which a plurality of the nozzles 63 are bored at a pitch (for example, 180 dpi) corresponding to a dot formation density. As a material of the nozzle substrate 56, it is possible to employ a metal plate formed of such as stainless steel or a silicon single crystal substrate similar to the flow path substrate 55 to be described below. In the nozzle substrate 56, two nozzles rows 64 (nozzle groups) are provided, in which the plurality of nozzles 63 are aligned, and one nozzle row 64 is configured to include, for example, 180 nozzles 63. The undersurface (surface on a side on which the ink is ejected from the nozzle 63) of the nozzle substrate 56 is the nozzle surface. The number of nozzles rows 64 formed in the nozzle substrate 56 and the number of and the pitch between the nozzles 63 which configure the nozzle row 64 are not limited to the corresponding example in the present embodiment and it is possible to employ various configurations.

As illustrated in FIG. 8, the vibrating plate 57 which is the uppermost layer of the flow path unit components has a double structure in which an elastic film 67 (flexible member) is stacked under the surface (undersurface) of a support plate 66. In the present embodiment, the vibrating plate 57 is configured of a composite plate material in which a metal plate formed of such as stainless steel is used as the support plate 66 and a resin film used as the elastic film 67 is laminated on the surface of the support plate 66. The vibrating plate 57 is provided with a diaphragm 68 which changes a volume of the pressure chamber 61. The diaphragm 68 is formed by partially removing the support plate 66 through etching or the like. That is, the diaphragm 68 is formed to have an insular portion 69 to which an end surface of a free end section of the piezoelectric element 48 is joined and a flexible portion 70 provided on the periphery of the insular portion 69. The end surface of the piezoelectric element 48 is joined to the insular portion 69. It is possible to cause the diaphragm 68 to be displaced by expanding and contracting the free end section of the piezoelectric element 48 and it is possible to cause the volume of the pressure chamber 61 to fluctuate.

In addition, in the vibrating plate 57, a compliance unit 72 which seals (partitions) the common liquid chamber 59 is provided in a portion corresponding to the common liquid chamber 59 of the flow path substrate 55. The compliance unit 72 is formed by removing the support plate 66 in a region corresponding to an opening surface of the common liquid chamber 59 through etching or the like and leaving only the elastic film 67 in the corresponding portion. The compliance unit 72 functions as a damper which absorbs pressure fluctuation of a liquid retained in the common liquid chamber 59. An upper opening (opening on the head case 24 side) of the compliance unit 72 is sealed by the undersurface of the head case 24 when the flow path unit 25 is joined to the undersurface of the head case 24 and the compliance space 73 is partitioned. The compliance space 73 is separated from the common liquid chamber 59 via the elastic film 67 and is a space which allows the elastic film 67 to be deformed in accordance with pressure change in the common liquid chamber 59. A lower end of the atmosphere opening communicating path 52 of the head case 24 communicates with the compliance space 73. That is, the compliance space 73 communicates with the joint space 82 via the atmosphere opening communicating path 52 and the atmosphere opening intra-head through-hole 88. The four vibrating plate through-holes 58 which communicate with the common liquid chamber 59 and the case flow paths 51 are aligned substantially at the center of the vibrating plate 57 corresponding to the case flow paths 51 in the nozzle row direction.

The flow path substrate 55 according to the present embodiment is a plate-shaped member in which cavities are formed by partitioning the ink flow path, specifically, the cavities being a cavity to become the common liquid chamber 59, a cavity to become the ink supply port 60, a cavity to become the pressure chamber 61 (hereinafter, the cavities are simply referred to as the common liquid chamber 59, the ink supply port 60, and the pressure chamber 61, respectively). The flow path substrate 55 is formed through anisotropic etching of a silicon wafer which is a type of a crystalline base material. In the flow path substrate 55 of the present embodiment, one common liquid chamber 59 is formed with respect to the nozzle row on one side (left side in FIG. 9) and three common liquid chambers 59 are formed with respect to the nozzle row on the other side (right side in FIG. 9) in the nozzle row direction. Black ink is guided into the common liquid chamber 59 on one side and all colors of cyan ink, magenta ink, and yellow ink are guided into the common liquid chambers 59 on the other side.

Ink guided from the ink cartridge 17 via the ink guiding-in unit 31, the intra-holder flow path 76, and the intermediate flow path 39 into the head unit 22 is supplied into the nozzle 63 through a line of flow paths (corresponding to intra-head flow path in the invention) which is configured to include the case flow path 51, the common liquid chamber 59, the ink supply port 60, and the pressure chamber 61. In this state, the piezoelectric element 48 is driven and the pressure fluctuates in the pressure chamber 61. The pressure fluctuation causes an ink droplet to be ejected from the nozzle 63.

Regarding sizes of the components of the recording head 3 in the direction orthogonal to the nozzle row (carriage scanning direction), as illustrated in FIG. 7, the flow path plate 20 and the holder 19 have a larger size than the head unit 22. In addition, a center line Ch of the head unit 22 is eccentrically placed toward one side (the one-end-side side wall 7' side of the body frame 7 in a state of being mounted on the carriage 10), from a center line C' of the flow path plate 20 and the holder 19 in the carriage scanning direction (horizontal direction in FIG. 7). In the present embodiment, the center line Ch of the head unit 22 is a virtual line passing through the center of the nozzle substrate 56 in the same direction as the direction orthogonal to the nozzle row. In addition, in the present embodiment, the center line C' of the flow path plate 20 and the holder 19 in the carriage scanning direction is placed substantially at the same position as a center line Cc (refer to FIG. 3) of the carriage in the carriage scanning direction. That is, as illustrated in FIG. 3, the head unit 22 is eccentrically disposed toward one side from the center line Cc of the carriage in the carriage scanning direction. In this manner, on the lower side of the carriage 10, the accommodation space S is formed on the side opposite to the head unit 22. As illustrated in FIG. 3, the connector 43 of the circuit substrate 21, a paper width sensor 85, or the like is arranged in the accommodation space S.

Figure 11A:
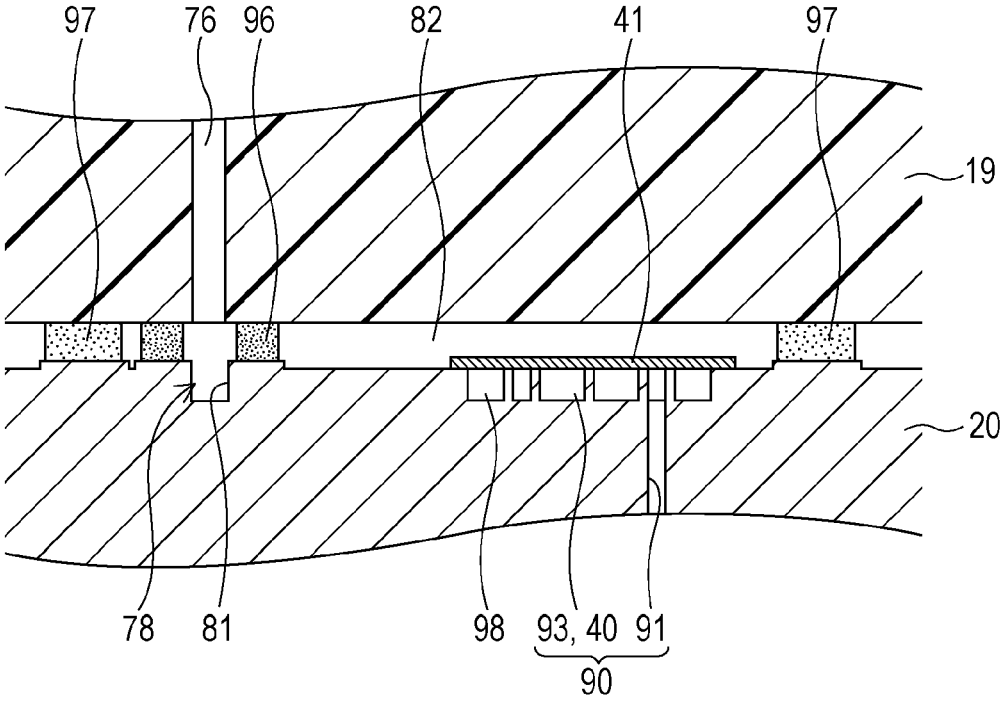
FIG. 11A is a cross-sectional view taken along line XIA-XIA in FIG. 10B
Figure 11B:
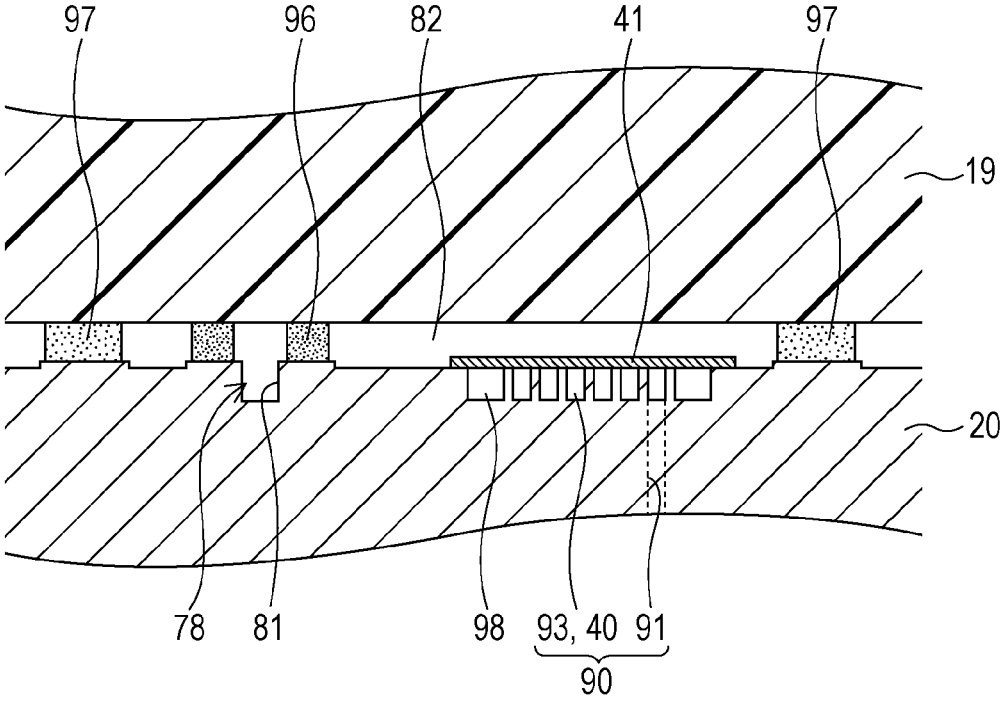
FIG. 11B is a cross-sectional view taken along line XIB-XIB in FIG. 10B.

Hereinafter, the joint space 82 which is formed in a joint surface between the holder 19 and the flow path plate 20 will be described in detail. FIG. 10A is a plan view of the flow path plate before the base plate is joined and FIG. 10B is a plan view of the flow path plate after the base plate is joined. In addition, FIG. 11A is a cross-sectional view taken along line XIA-XIA in FIG. 10B and FIG. 11B is a cross-sectional view taken along line XIB-XIB in FIG. 10B. FIG. 10A illustrates a position at which the adhesive is applied, by a broken line.

As described above, a plurality of the intra-joint-surface flow paths 78 which configure an upstream side of the intermediate flow path 39 are formed in the joint space 82. As illustrated in FIGS. 11A and 11B, a periphery of a concave flow path forming groove 81 (corresponding to the groove in the invention) formed on the top surface (joint surface) of the flow path plate 20 is surrounded by a first adhesive 96 and sealing is performed by the undersurface of the holder 19 (base plate 30) and the intra-joint-surface flow path 78 is formed. That is, the intra-joint-surface flow paths 78 are partitioned by the flow path forming groove 81 and the first adhesive 96 between the flow path plate 20 and the holder 19. In the present embodiment, as illustrated in FIG. 10B, four intermediate flow paths 39 are formed corresponding to four colors of ink. The intra-joint-surface flow paths 78 extend from a position corresponding to the opening on the lower end side of the intra-holder flow path 76 to the opening on the upstream side of the intra-plate flow path 79 which configures the downstream side of the intermediate flow path 39 and allow both the intra-holder flow path and the intra-plate flow path to communicate. The four intra-plate flow paths 79 are aligned corresponding to the case flow paths 51 aligned substantially at the center of the head unit 22. In the present embodiment, as described above, since the center line Ch of the head unit 22 is eccentrically placed on one side from the center line C' of the flow path plate 20 in the carriage scanning direction, the row of the intra-plate flow paths 79 is formed to be eccentric to one side in the same direction. Therefore, the intra-joint-surface flow path 78 which is in contact with the intra-plate flow path 79 corresponding to the intra-holder flow path 76 is formed in a different length. In the present embodiment, the intra-joint-surface flow path 78*a* corresponding to the black ink is formed to become the longest one.

A space outside of the intra-joint-surface flow path 78 in the joint surface is sealed using the second adhesive 97 such that release of moisture from the ink in the intra-joint-surface flow path 78 to the atmosphere after passing through the first adhesive 96 is suppressed. That is, as illustrated in FIG. 10B, the outer periphery of the first adhesive 96 of the intra-joint-surface flow path 78 is enclosed using the second adhesive 97 and a void between the flow path plate 20 and the holder 19 is sealed such that the joint space 82 which includes the intra-joint-surface flow path 78 is formed. In this manner, humidity in the joint space 82 is likely to be maintained and it is possible to suppress evaporation of moisture from the ink in the intra-joint-surface flow path 78. In the present embodiment, gas permeability of the second adhesive 97 (to be more exact, a second hardened product obtained by hardening the second adhesive 97) is set to be lower than gas permeability of the first adhesive 96 (to be more exact, a first hardened product obtained by hardening the first adhesive 96). Then, even if the moisture from the ink of the intra-joint-surface flow path 78 passes through the first adhesive 96, the moisture is retained in the joint space 82 and the humidity in the joint space 82 is more likely to be maintained and it is possible to further suppress evaporation of the ink in the intra-joint-surface flow path 78. The first adhesive 96 and the second adhesive 97 are applied on the flow path plate 20 using a method such as D spacer or transfer printing. In addition, in the present embodiment, as illustrated in FIG. 11A and FIG. 11B, a region on which the first adhesive 96 and the second adhesive 97 are applied is slightly raised from the top surface of the flow path plate 20 in a convex shape.

Here, the second adhesive 97 is bent at a portion in the joint surface and is applied so as to completely enclose the periphery of the intra-joint-surface flow path 78 and the atmosphere opening path 90 (to be described below). At least a part of the second adhesive 97 is formed in a state of passing through inside of a straight line (hereinafter, virtual straight line) Lv connecting an end of one intra-joint-surface flow path 78 on the outer side and an end of another intra-joint-surface flow path 78 on the outer side within the joint surface. Particularly, in the present embodiment, at least a part of the second adhesive 97 is formed inside of the virtual straight line Lv connecting an end of one intra-joint-surface flow path 78 on the outer side and an end of another intra-joint-surface flow path 78 on the outer side which is adjacent to the end of the one intra-joint-surface flow path within the joint surface. Here, "being adjacent" means a state in which, when the virtual straight line is caused to extend from an end of one intra-joint-surface flow path 78 on the outer side to an end of another intra-joint-surface flow path 78 on the outer side which is different from the end of the one intra-joint-surface flow path, the virtual straight line does not cross over the other intra-joint-surface flow path 78. Specifically, in the present embodiment, a part of the second adhesive 97 is formed inside of a virtual straight line Lv connecting an end of an intra-joint-surface flow path 78*a* corresponding to the black ink on the outer side (second adhesive 97 side or the side (intra-holder flow path 76 side) opposite to the intra-plate flow path 79 side corresponding to the intra-joint-surface flow path 78*a*) and an end of an intra-joint-surface flow path 78*b* on the outer side (second adhesive 97 side or the side (intra-holder flow path 76 side) opposite to the intra-plate flow path 79 side corresponding to the intra-joint-surface flow path 78*b*) which is adjacent to the intra-joint-surface flow path 78*a* of the intra-joint-surface flow paths 78 corresponding to the color inks. At least a part of the second adhesive 97 may be formed inside of the virtual straight line connecting an end of one intra-joint-surface flow path 78 on the outer side and an end of another intra-joint-surface flow path 78 on the outer side which is not adjacent to the end of the one intra-joint-surface flow path, within the joint surface.

In order to form the second adhesive 97 as described above, it is preferable that a pattern of the second adhesive has a pentagonal or higher polygonal shape within the joint surface. For example, in a case of enclosing the intra-joint-surface flow paths using a quadrangular pattern for the second adhesive, an inner area of a region demarcated by the second adhesive 97 within the joint surface is likely to become larger. That is, it is difficult to decrease a volume in the joint space 82. Therefore, the pattern of the second adhesive 97 including the intra-joint-surface flow path 78 is a pentagonal or more polygonal shape within the joint surface and the second adhesive is formed to pass through the inside of the above virtual straight line Lv. According to the present embodiment, the pattern of the second adhesive 97 is formed to have a heptagonal shape. In addition, it is preferable that, at least one corner of the corners of the pattern is formed to have an interior angle of 90 degrees or less. In this manner, it is possible to further decrease an area inside a region demarcated by the second adhesive 97 in the joint space. As a result, it is possible to decrease the volume in the joint space 82. In the present embodiment, an interior angle on one corner (corner on the right side in FIGS. 10A and 10B) is formed to be 90 degrees or less in the pattern of the second adhesive 97. In this manner, it is possible to further decrease an area inside of a region demarcated by the second adhesive 97 within the joint surface compared to a case where the corner is greater than 90 degrees and it is possible to further decrease the volume in the joint space 82. In short, the second adhesive 97 is bent to pass through a position close to the intra-joint-surface flow path 78 and thus, it is preferable that an application pattern is formed to have as small an area as possible.

Since at least a part of the second adhesive 97 is formed inside of the virtual straight line Lv connecting the end of the intra-joint-surface flow path 78*a* on the outer side and the end of the other intra-joint-surface flow path 78*b* on the outer side, within the joint surface, it is possible to decrease an area of an inside region which is demarcated by the second adhesive 97. In this manner, it is possible to decrease a volume in the joint space 82 and, although moisture from ink of the intra-joint-surface flow path 78 may pass through the first adhesive 96, the moisture is retained in the joint space 82 and the humidity in the joint space 82 is likely to be maintained. As a result, it is possible to further suppress evaporation of ink in the intra-joint-surface flow path 78. In addition, since moisture from ink which is newly guided in (flows relatively in upstream of the recording head 3 in the inner flow path) from the ink cartridge 17 forms a high humidity state in the joint space 82, the ink in the vicinity of the nozzle is less likely to have a high viscosity compared to using the moisture from the ink on a side (downstream side) closer to the nozzle 63.

In addition, when the joint space 82 is completely sealed, there is a concern that expansion of a gas in the joint space 82 due to a humidity change may cause the first adhesive 96 or the second adhesive 97 to break. Therefore, the atmosphere opening path 90 which allows the inside of the joint space 82 to be open to the atmosphere is formed. A cross-sectional area and the full length of a passage of the atmosphere opening path 90 are determined so as to prevent the passing of the moisture (vapor), in other words, so as to resist the passage of the moisture. In this manner, it is possible to prevent the moisture inside the joint space 82 from passing through the atmosphere opening path 90 and it is possible for joint space 82 to be open to the atmosphere. The atmosphere opening path 90 of the present embodiment is configured to include the meandering route 93 which is sufficiently finer than the flow path for ink provided in the recording head 3 and an atmosphere opening through-hole 91 that makes the meandering route 93 be open to the atmosphere.

As described above, the meandering route 93 is formed by sealing the upper opening of the meandering route forming groove 40 formed in the joint surface direction of the flow path plate 20 using a thin film 41. The meandering route forming groove 40 is formed to meander in the joint surface direction in a concave meandering route forming space 98 formed inside of the joint space 82. Specifically, the meandering route forming groove 40 of the present embodiment extends in a direction orthogonal to the nozzle row direction (alignment direction of the intra-plate flow path 79) from an end on one side in the meandering route forming space 98 and extends in a direction orthogonal to a nozzle row direction when the meandering route forming groove 40 is retracted to the side opposite to the expansion direction at the other-side end portion. When such expansion and retraction are repeatedly performed a plurality of times, the meandering route forming groove 40 which meanders is formed. As illustrated in FIG. 10A, an end section of the meandering route forming groove 40 on the one side is open to the meandering route forming space 98. Then, an end of the meandering route forming groove 40 on the other side is not open into the meandering route forming space 98 and is closed in a joint surface direction (that is, a dead end in the extension direction of the groove). The upper end of the atmosphere opening through-hole 91 is open to the end of the meandering route forming groove 40 on the other end. As illustrated in FIG. 10B, the film 41 is joined to the top surface of the flow path plate 20 in a thermally adhered manner so as to cover the opening on the top surface of the meandering route forming space 98 and the upper opening of the meandering route forming groove 40 is sealed. In this manner, the meandering route 93 is separately formed. At this time, the opening on the top surface of the meandering route forming space 98 is not completely sealed using the film 41 but the end section of the meandering route forming space 98 on one side (left side in FIG. 10B) is open. In such a configuration, the end section of the meandering route forming groove 40 on the one side communicates with the joint space 82 via the open portion.

The atmosphere opening through-hole 91 penetrates the flow path plate 20 in the plate thickness direction and communicates with the meandering route 93 and outside of the recording head 3. The end section of the atmosphere opening through-hole 91 on one side (lower side) is open on the undersurface of the flow path plate 20 and the end section on the other side (upper side) is open in the end section of the meandering route 93 on the other side. In this manner, the joint space 82 is open to the atmosphere outside of the recording head 3 via the atmosphere opening path 90 which is formed to have the atmosphere opening through-hole 91 and the meandering route 93. The end section of the atmosphere opening through-hole 91 on the one side according to the present embodiment is open on the undersurface of the flow path plate 20 in the accommodation space S.

In addition, in the present embodiment, as illustrated in FIGS. 10A and 10B, the upper end of the atmosphere opening intra-head through-hole 88 which penetrates the flow path plate 20 in the plate thickness direction is open at a position apart from the intra-joint-surface flow path 78 in the joint space 82 in the alignment direction of the intra-plate flow paths 79. The atmosphere opening intra-head through-hole 88 communicates with the atmosphere opening communicating path 52 via the atmosphere opening connection unit 87 of the head case 24. That is, the compliance space 73 communicates with the joint space 82. As described above, since the joint space 82 is open to the atmosphere, the compliance space 73 is also open to the atmosphere. That is, the compliance space 73 is open to the atmosphere via the atmosphere opening communicating path 52, the atmosphere opening connection unit 87, the atmosphere opening intra-head through-hole 88, the joint space 82 and the atmosphere opening path 90. In addition, since the humidity in the joint space 82 is maintained by the meandering route forming groove 40 as described above, releasing of the moisture in the compliance space 73 is suppressed. In this manner, the evaporation of the moisture from the ink in the common liquid chamber 59 is suppressed.

In the configuration described above, it is possible for the recording head 3 to become thinner (size in a stacking direction of the components) than in a case where, similar to a configuration in the related art, another member such as a seal member formed of a resin such as an elastomer in which an atmosphere opening path is interposed between a flow path plate and a holder. In addition, since a restoring force is unlikely to be produced due to interposing another member, it is possible for the size of the flow path plate 20 and the holder 19 to become thinner. As a result, it is possible to miniaturize the recording head 3. Further, since the meandering route forming groove 40 is sealed by the fixed film 41 and thereby, the meandering route 93 which causes the joint space 82 to be open to the atmosphere is formed, there is no need to attach another separate member in which the atmosphere opening path 90 is formed. In this manner, assembling properties of the recording head 3 are improved and the recording head 3 is easily manufactured. In addition, since the film 41 is disposed between the flow path plate 20 and the holder 19, it is possible to protect the film 41 from an external force, or the like.

Incidentally, in the present embodiment, a so-called longitudinal vibration type piezoelectric element is employed as the actuator in the invention; however the actuator is not limited thereto. It is possible to employ a so-called electrostatic actuator which displaces a part of the pressure chamber by an electrostatic force, or another actuator such as a heat generating element which causes pressure to fluctuate in the pressure chamber by bubbles produced in a liquid through heating.

As above, as an example of the ink jet printer, the printer 1 in which the recording head 3 which is a type of the inkjet-head is mounted on the carriage 10 is described; however the configuration is not limited thereto. The invention can be applied to another ink jet printer in which an inkjet-head which is configured to include a plurality of components assembled at determined positions is mounted on a member corresponding to the carriage. For example, the invention can be applied to a color-material ejecting head which is mounted on a display manufacturing printer which manufactures a color filter such as a liquid crystal display, an electrode-material ejecting head which is mounted on an electrode producing printer which forms an electrode such as an organic electro luminescence (EL) display or a field emission display (FED), or the like.

What is claimed is:

1. An inkjet-head comprising:

a first flow path member in which a plurality of first flow paths are formed; and a second flow path member in which a plurality of second flow paths are formed and to which the first flow path member is bonded, wherein the second flow paths have intra-joint-surface flow paths, respectively, which are formed by surrounding, with a first adhesive, a peripheral edge of a groove formed in the second flow path member and bonding the first flow path member thereto, wherein a joint space is formed and includes a plurality of the intra-joint-surface flow paths due to surrounding, with a second adhesive, an outer periphery of the intra-joint-surface flow paths and bonding the second flow path member and the first flow path member, and wherein at least a part of the second adhesive is formed further inside of a straight line connecting an end of one intra-joint-surface flow path on the outer side and an end of another intra-joint-surface flow path on the outer side in joined surfaces.

2. The inkjet-head according to claim 1, wherein gas permeability of a second hardened product obtained by hardening the second adhesive is lower than gas permeability of a first hardened product obtained by hardening the first adhesive.

3. An ink jet printer comprising:

the inkjet-head according to claim 1.

4. An ink jet printer comprising:

the inkjet-head according to claim 2.

* * * * *